US008630555B2

(12) United States Patent
Kanakubo

(10) Patent No.: US 8,630,555 B2
(45) Date of Patent: Jan. 14, 2014

(54) PRINTING APPARATUS AND CONTROL METHOD FOR PRINTING APPARATUS

(75) Inventor: Yukio Kanakubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 13/104,875

(22) Filed: May 10, 2011

(65) Prior Publication Data

US 2011/0280593 A1 Nov. 17, 2011

(30) Foreign Application Priority Data

May 11, 2010 (JP) ..... 2010-109546

(51) Int. Cl.
*G03G 15/08* (2006.01)

(52) U.S. Cl.
USPC ..... 399/27; 399/227

(58) Field of Classification Search
USPC ..... 399/12, 27–29, 226, 227
See application file for complete search history.

(56) References Cited

U.S. PATENT DOCUMENTS

| | | | | |
|---|---|---|---|---|
| 6,375,297 | B1 | 4/2002 | Hayashi | |
| 2001/0049703 | A1 | 12/2001 | Miyoshi | |
| 2004/0234282 | A1 * | 11/2004 | Hamano et al. | 399/27 |

FOREIGN PATENT DOCUMENTS

| | | | |
|---|---|---|---|
| EP | 1475235 | A1 | 11/2004 |
| JP | 2002-304267 | A | 10/2002 |
| JP | 2003-323027 | A | 11/2003 |
| JP | 2004-271956 | A | 9/2004 |
| JP | 2008-023785 | A | 2/2008 |

* cited by examiner

*Primary Examiner* — Hoang Ngo
(74) *Attorney, Agent, or Firm* — Canon USA Inc IP Division

(57) ABSTRACT

A printing apparatus includes a plurality of container units containing a recording material. In a case where it is determined that a container unit is lacking in the recording material when printing is executed based on print data, the printing apparatus moves the container unit determined to be lacking in the recording material to a replaceable position. In a case where the container unit determined to be lacking in the recording material is not a specific container unit among the plurality of container units and the printing based on the print data is canceled without replacing the container unit determined to be lacking in the recording material, the printing apparatus moves the specific container unit to a specific position in preparation for printing using the specific container unit.

18 Claims, 7 Drawing Sheets

PRINTING APPARATUS AND CONTROL METHOD FOR PRINTING APPARATUS

BACKGROUND OF THE INVENTION

1. Field of the Invention

The present invention relates to a printing apparatus for printing using a recording material and, in particular, to a printing apparatus having a plurality of container units containing the recording material.

2. Description of the Related Art

Japanese Patent Application Laid-Open No. 2003-323027 discusses a printing apparatus that prints data by rotating and moving a plurality of toner cartridges, in which when toner is exhausted in one toner cartridge, the toner cartridge is then moved to a replaceable position, and a user can replace the toner cartridge.

In a printing apparatus for performing printing by rotating and moving a plurality of toner cartridges, a standby position (home position) of a toner cartridge is provided to start printing most quickly. When the toner cartridge is located at the standby position, the printing apparatus can start printing most quickly. On the other hand, if the printing apparatus starts printing while the toner cartridge is not located at the standby position, the printing apparatus temporarily moves the toner cartridge to the standby position and then executes printing. Therefore, the start of printing of the first page is delayed. Thus, first printing is delayed.

When toner of a toner cartridge for color other than that for black is exhausted, color printing cannot be executed but monochrome printing using only the toner cartridge for black can be executed. However, in a case where toner of a toner cartridge for color other than that for black is exhausted and a print job of the monochrome printing is received in a state in which that toner cartridge is moved to a replaceable position, the toner cartridge for black is not located at the above-mentioned standby position, so that the start of printing may be delayed.

In a case where, as toner of the toner cartridge for color other that for black is exhausted in progress of color printing, a print job in progress of the printing is thus temporarily canceled and the monochrome printing is to be executed, the start of monochrome printing is delayed. When only the monochrome printing is used until a toner cartridge for replacement is delivered because there is not the toner cartridge for replacement on hand, the start of monochrome printing is also delayed.

SUMMARY OF THE INVENTION

The present invention is directed to a printing apparatus capable of starting printing using a specific container unit quickly as much as possible if the specific container unit is not lacking in a recording material even when it is determined that any one of a plurality of container units containing a recording material is lacking in the recording material.

According to an aspect of the present invention, a printing apparatus for performing printing using a recording material includes a plurality of moveable storing units for storing the recording material; a determination unit arranged to determine whether any of the storing units are depleted of recording material and further arranged to, in the case that it is determined that a storing unit is depleted, determine whether the depleted storage unit is a specific storage unit from among the plurality of storing units; and a control unit arranged to, in the case that the determining unit determines that the depleted storing unit is not the specific storing unit, perform control to move the specific storing unit to a specific position in preparation for printing using the specific storing unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
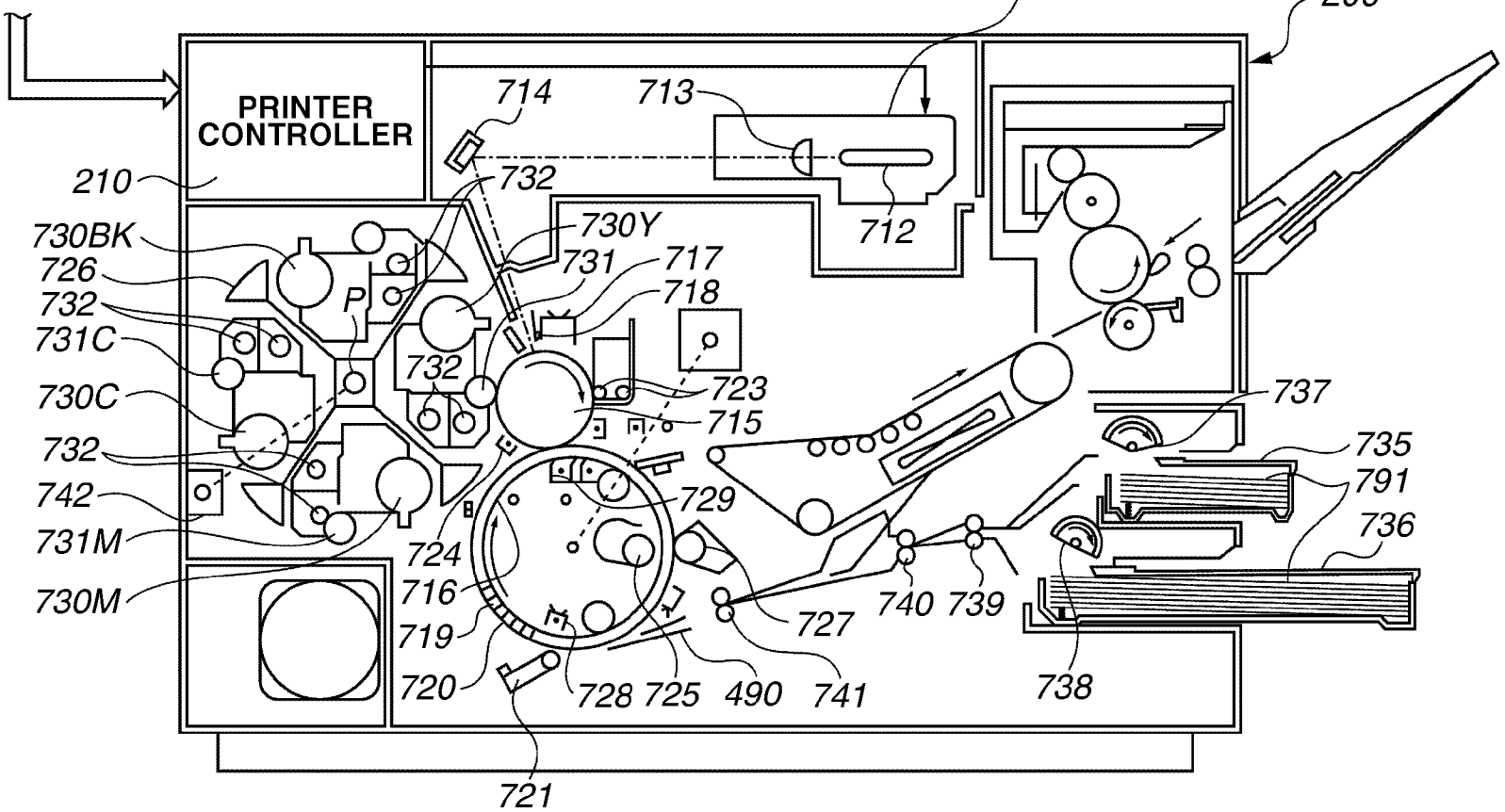
FIG. 1 illustrates an internal configuration of a color laser printer of the rotational developing rotary type as an example of a printing apparatus according to an exemplary embodiment of the present invention.

FIG. 1 illustrates an internal configuration of a color laser printer of the rotational developing rotary type as an example of a printing apparatus 200 according to an exemplary embodiment of the present invention. The printing apparatus 200 is illustrated as an example, using toner as a recording material for printing.

A scanner 711 includes a laser output unit (not illustrated) that converts an image signal from a printer controller 210 into an optical signal (laser beams), a polygon mirror 712 as an octahedral member, a motor (not illustrated) that rotates the polygon mirror 712, and an f/θ lens (image-forming lens) 713. The laser beams output from the laser output unit are reflected by one side surface of the polygon mirror 712, pass through the f/θ lens 713, reflect from a reflection mirror 714, and linearly raster-scan a surface of a photosensitive drum 715. The photosensitive drum 715 is rotated in the direction illustrated by an arrow. Thus, an electrostatic latent image corresponding to an image represented by the image signal is formed on the surface of the photosensitive drum 715. A primary charger 717, a whole-surface exposure lamp 718, a cleaner unit 723 for recovering the remaining toner that is not transferred to a sheet, and a pre-transfer charger 724 are arranged around the photosensitive drum 715.

A developing unit 726 develops the electrostatic latent image formed on the surface of the photosensitive drum 715 with the following configuration.

Toner hoppers 730Y, 730M, 730C, and 730Bk each contain toner as a developer. Screws 732 transmit the developers stored in the toner hoppers 730Y, 730M, 730C, and 730Bk to developing sleeves 731Y, 731M, 731C, and 731Bk. The developing sleeves 731Y, 731M, 731C, and 731Bk come into contact with the photosensitive drum 715, and develop images with the developers. More specifically, toner images are formed with yellow, magenta, cyan, and black developers on the photosensitive drum 715. The toner hoppers 730Y, 730M, 730C, and 730Bk, the developing sleeves 731Y, 731M, 731C, and 731Bk, and the screws 732 are arranged around a central axis P of the developing unit 726. Different colors Y, M, C, and Bk are yellow, magenta, cyan, and black, respectively. The toner cartridge for each color includes the toner hopper and the developing sleeve.

A position sensor 742 detects the rotational position of the developing unit 726. When forming a yellow toner image on the photosensitive drum 715, the developing unit 726 is rotated around the central axis P, and the photosensitive drum 715 comes into contact with the developing sleeve 731Y. FIG. 1 illustrates this status. When forming a magenta toner image, the developing unit 726 is rotated around the central axis P, and the photosensitive drum 715 comes into contact with the developing sleeve 731M. When forming cyan and black toner images, similar operations are performed.

A transfer drum 716 transfers the toner images formed on the photosensitive drum 715 to the sheet. An actuator plate 719 detects a movement position of the transfer drum 716. A position sensor 720, which is located close to the actuator plate 719, detects that the transfer drum 716 is moved to the home position. The actuator plate 719, the position sensor 720, a transfer drum cleaner unit 725, a sheet pressing roller 727, and a neutralization device 729 as transfer chargers are arranged around the transfer drum 716.

Sheet feeder cassettes 735 and 736 store sheets 791. The sheet feeder cassette 735 contains A4-size sheets, and the sheet feeder cassette 736 contains A3-size sheets. When the sheet is fed and conveyed, sheet feeder rollers 737 and 738 feed the sheets 791 from the sheet feeder cassettes 735 and 736. Timing rollers 739, 740, and 741 control the timing for feeding and conveying the sheets 791. The sheets 791 are guided to a sheet guide 743 via the timing rollers 739, 740, and 741. A gripper 728 carries the edge of the sheet and the sheet is wound around the transfer drum 716. One of the sheet feeder cassettes 735 and 736 is selected in response to an instruction from the printer controller 210. Only one of the sheet feeder rollers 737 and 738 corresponding to the selected sheet feeder cassette is rotated.

With the above-described configuration, full-color printing with four colors, Y, M, C, and Bk, is realized.

In the printing apparatus 200 illustrated in FIG. 1, the printer controller 210 is closed or opened like a door and functions as a cover, at which a user can replace the toner cartridge.

Figure 2:
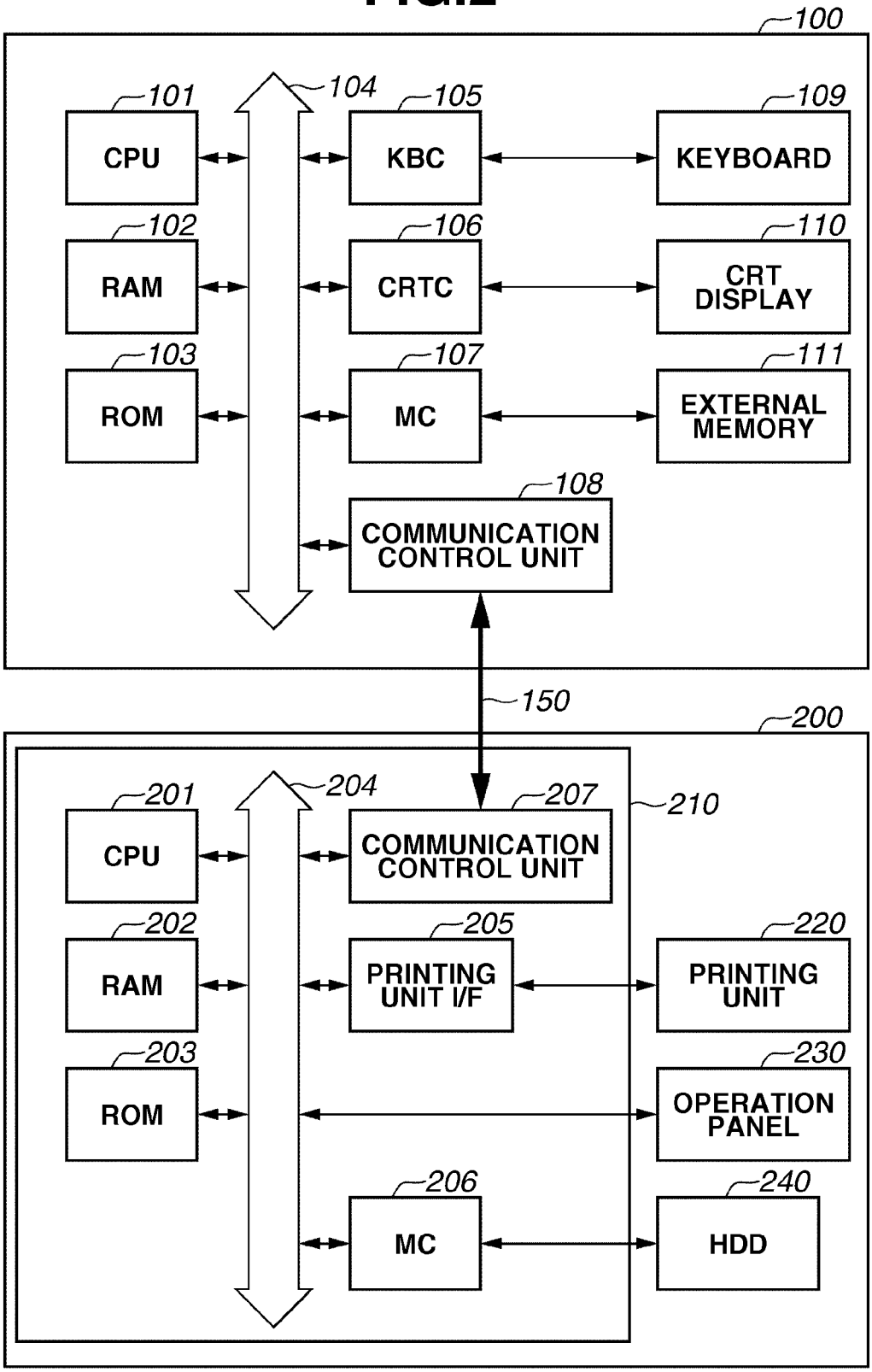
FIG. 2 is a block diagram illustrating a configuration of a printing system according to an exemplary embodiment of the present invention.

FIG. 2 is a block diagram illustrating a configuration of a printing system according to an exemplary embodiment of the present invention. In the printing system, a host computer 100 can communicate with the printing apparatus 200 via a communication medium 150. The communication medium 150 is an interactive interface, such as a local area network (LAN), a universal serial bus (USB) cable, or a wireless LAN.

A central processing unit (CPU) 101 processes a document comprising one or more of a graphic, an image, a character, or a table (including spreadsheet) based on a program stored in a read-only memory (ROM) 103 or a hard disk drive (HDD) (not illustrated). The CPU 101 comprehensively controls devices connected to a system bus 104 based on the program stored in the ROM 103 or the HDD.

A random access memory (RAM) 102 functions as a main memory or a work area for the CPU 101.

The ROM 103 includes a program ROM that stores various programs executed by the CPU 101, a font ROM that stores font data used for document processing, and a data ROM that stores various data used for document processing.

A keyboard controller (KBC) 105 controls a key input from a keyboard 109 or a pointing device (not illustrated), thereby transmitting contents of the key input to the CPU 101. A cathode ray tube (CRT) controller (CRTC) 106 controls a display operation on a cathode ray tube (CRT) display 110 in response to an instruction from the CPU 101. A memory controller (MC) 107 controls the access to an external memory 111 such as a hard disk, a compact disc (CD), or a digital versatile disc (DVD). The external memory 111 stores a boot program, various application programs, font data, a user file, or an editing file. A communication control unit 108 is connected to the printing apparatus 200 via the communication medium 150, and controls the communication with the printing apparatus 200.

The CPU 101 loads (performs rasterizing processing of) an outline font to a random access memory (RAM) for display arranged on the RAM 102 to enable the execution of "What You See Is What You Get" (WYSIWYG) on the CRT display 110. The CPU 101 opens various registered windows and executes various data processing in response to a command instructed with a mouse cursor displayed on the CRT display 110.

A central processing unit (CPU) 201 comprehensively controls devices connected to a system bus 204 based on a program stored in a read-only memory (ROM) 203 or a hard disk drive (HDD) 240. The CPU 201 outputs an image signal to a printing unit 220 via a printing unit interface (printing unit I/F) 205 based on the program stored in the ROM 203 or the HDD 240, and controls the printing unit 220 to print an image represented by an image signal.

A random access memory (RAM) 202 functions as a main memory or a work area for the CPU 201. An optional RAM is connected to an expansion port (not illustrated), thereby expanding a memory capacity of the RAM 202. The RAM 202 is used as a storage area that stores a drawing memory for storing image data converted from print data. The ROM 203 functions as a program ROM that stores a control program based on a flowchart illustrated in FIG. 5 or 6.

A communication control unit 207 is connected to the host computer 100 via the communication medium 150, and controls the communication with the host computer 100. The CPU 201 can communicate with the host computer 100 via the communication control unit 207, and can notify the host computer 100 of status information indicating the status of the printing apparatus 200.

An operation panel 230 includes a switch for operating the printing apparatus 200 by the user and a light-emitting diode (LED) display for displaying various information to the user. Further, the operation panel 230 may have a touch panel having a reception function of the operation and a display function of information.

A memory controller (MC) 206 controls the access to the HDD 240. The HDD 240 stores a program executed by the CPU 201 or print data received from the host computer 100.

Figure 3:
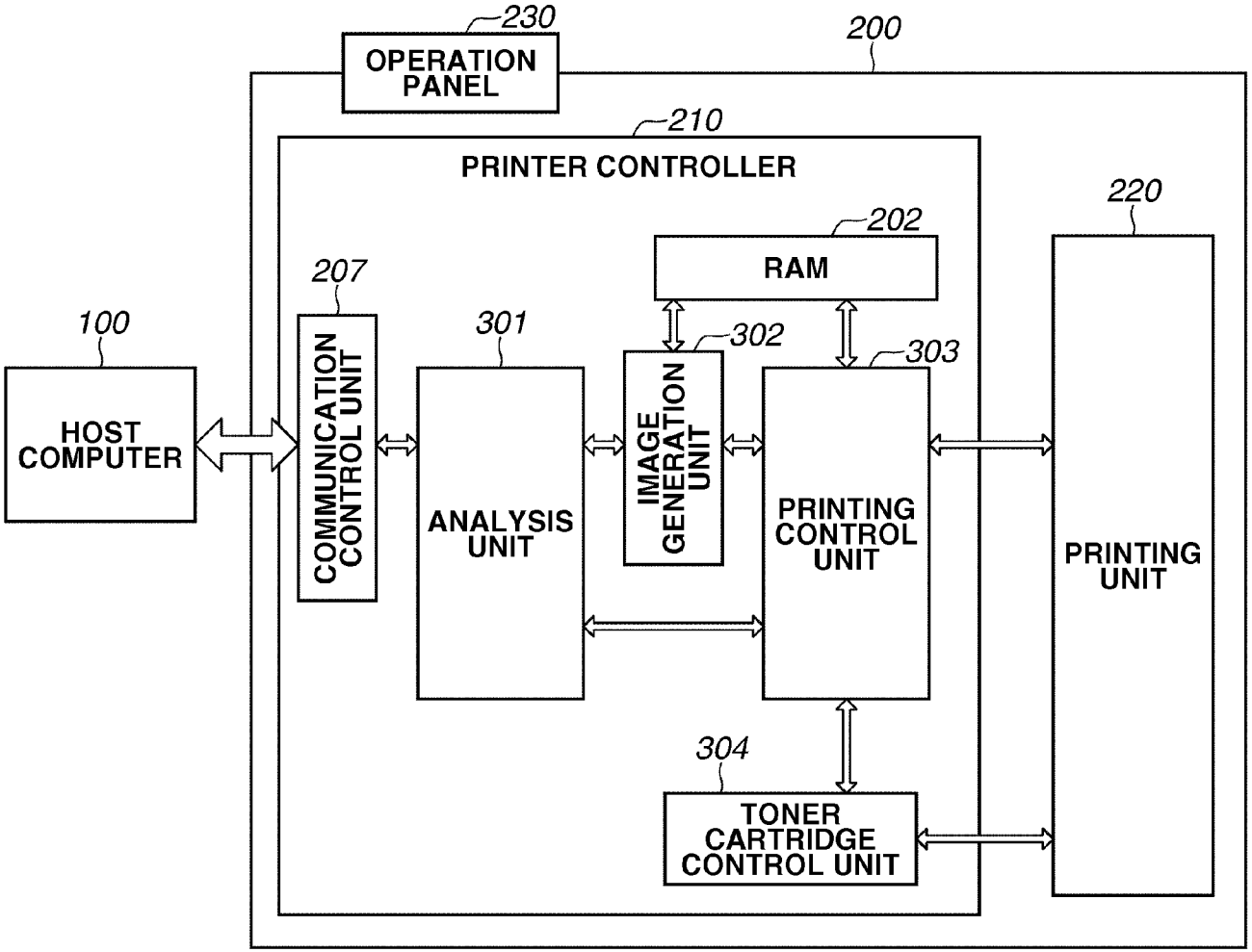
FIG. 3 is a block diagram illustrating a functional configuration for printer control by a central processing unit (CPU) in a printing apparatus in FIG. 2.

FIG. 3 is a block diagram illustrating a functional configuration of printer control by the CPU 201 in the printing apparatus 200 illustrated in FIG. 2. Referring to FIG. 3, the CPU 201 executes the program, thereby implementing an analysis unit 301, an image generation unit 302, a printing control unit 303, and a toner cartridge control unit 304.

The communication control unit 207 receives print data or a control command from the host computer 100, and transmits the data or command to the analysis unit 301. The analysis unit 301 includes a control program conforming to a control command system or a control program conforming to a print control language used for print data. Therefore, the analysis unit 301 interprets print data for drawing a character, graphic, or image, and transmits printing information based on the interpretation result to the image generation unit 302. The analysis unit 301 interprets a control command for instructing the selection of the sheet feeder cassette or the resetting of the printing unit 220, and sends the instruction based on the interpretation to the printing control unit 303.

The image generation unit 302 expands objects such as a character, a graphic, and an image to a bit map based on the printing information from the analysis unit 301, and stores bit map data on the RAM 202.

The printing control unit 303 controls the printing unit 220 according to the instruction from the analysis unit 301, converts the bit map data stored in the RAM 202 into a video signal (image signal), and outputs the video signal to the printing unit 220.

Figure 5:
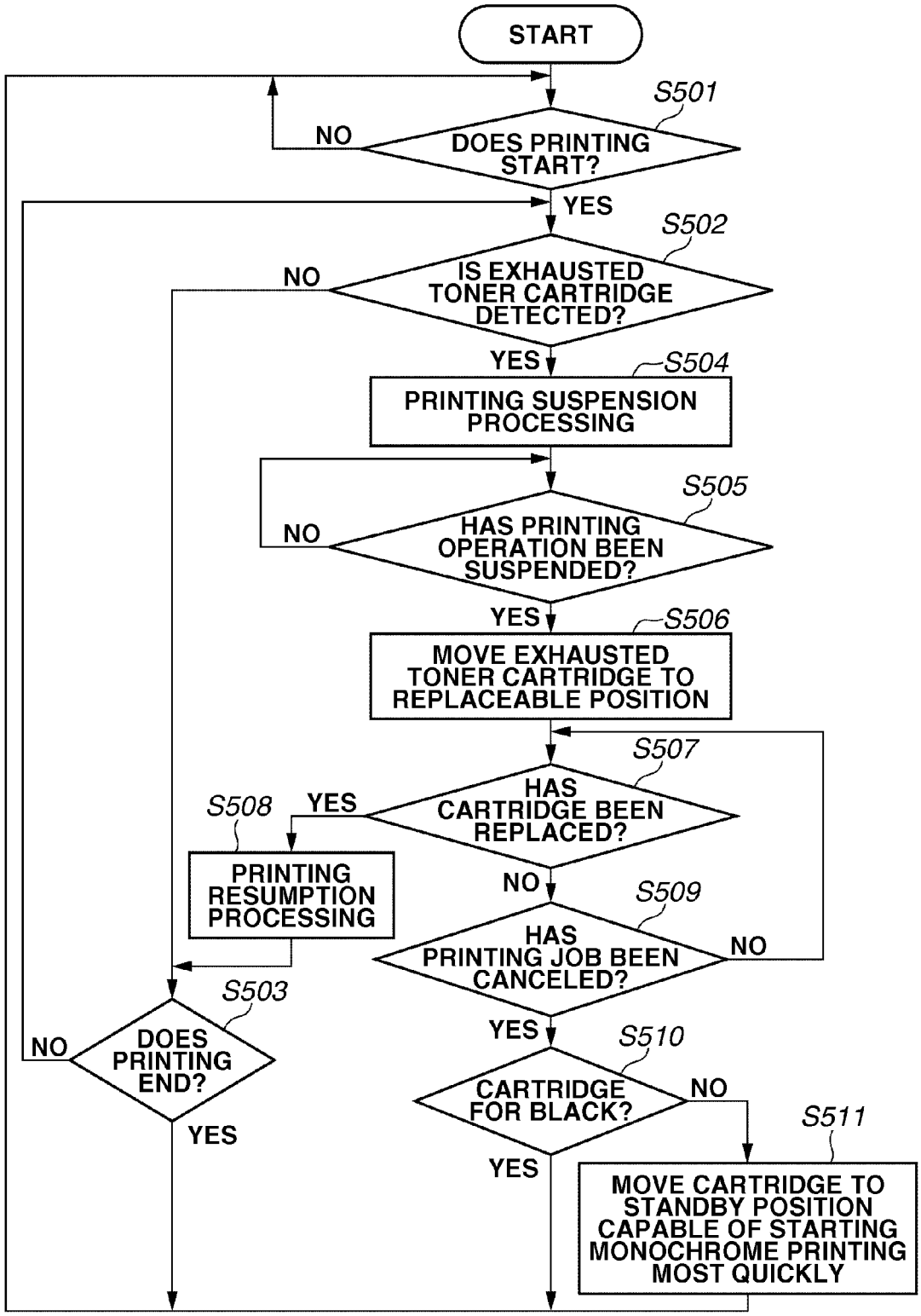
FIG. 5 is a flowchart of first processing executed by a toner cartridge control unit according to an exemplary embodiment of the present invention.

The toner cartridge control unit 304 moves the toner cartridge to the printing unit 220, and causes the printing unit 220 to execute the initialization operation, thus executing processing illustrated in FIG. 5.

The printing unit 220 receives a video signal from the printing control unit 303, and prints an image represented by the video signal on a sheet. An example of printing processing by the printing unit 220 is described above with reference to FIG. 1.

Figure 4:
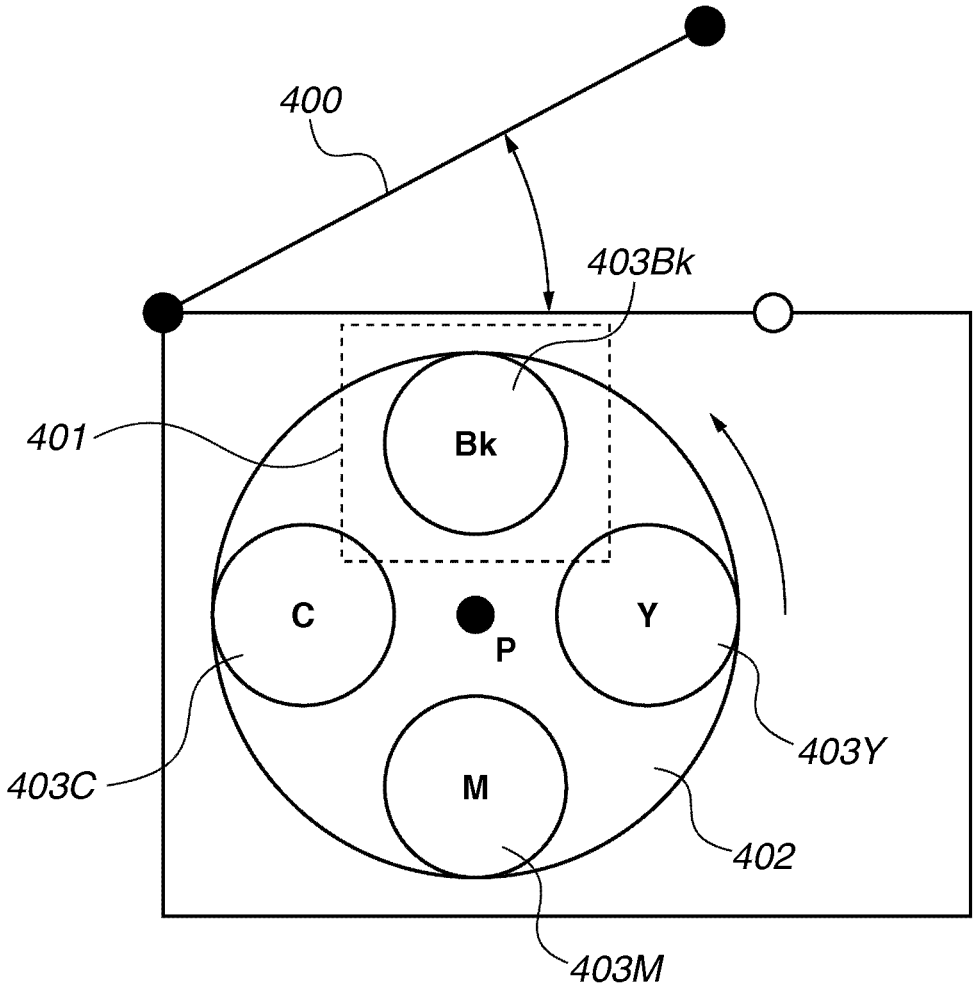
FIG. 4 illustrates a method for replacing a toner cartridge in the color laser printer of the rotational developing rotary type.

FIG. 4 illustrates a method for replacing the toner cartridge in the color laser printer of the rotational developing rotary type.

When the toner cartridge is replaced, the user opens a door 400. The door 400 functions as a cover. When the door 400 is opened, a position 401 just below the door 400 then becomes a position (hereinafter, referred to as a replaceable position) for replacing the toner cartridge, and the user can replace the toner cartridge located at the position 401. The replaceable position of the toner cartridge is not limited to the example illustrated in FIG. 4, and may be varied depending on the configuration of the printing apparatus 200.

The toner cartridge 403C is for cyan, the toner cartridge 403M is for magenta, the toner cartridge 403Y is for yellow, and the toner cartridge 403Bk is for black. In the example illustrated in FIG. 4, the toner cartridge 403Bk is located at the replaceable position.

The toner cartridges 403C, 403M, 403Y, and 403Bk are attached to a developing unit 402, which is rotatable around the central axis P. The toner cartridge control unit 304 issues a control command to the printing unit 220, thereby rotating the developing unit 402 to move an arbitrary toner cartridge to the replaceable position.

With the printer of the rotational developing rotary type, there is a cartridge status capable of starting printing most quickly, specifically, a standby position of the cartridge capable of starting printing most quickly. When printing is started with the cartridge in a position other than the standby position, the printer moves the cartridge to the standby position and then executes printing. Therefore, the start of printing is delayed. Thus, first printing is delayed. Accordingly, the present exemplary embodiment aims at preventing the delay of starting monochrome printing by performing processing, which will be described.

FIG. 5 is a flowchart of first processing executed by the toner cartridge control unit 304 according to an exemplary embodiment of the present invention.

In step S501, the toner cartridge control unit 304 determines whether printing starts. The printing control unit 303 may notify the toner cartridge control unit 304 whether printing starts.

When printing starts (YES in step S501), then in step S502, the toner cartridge control unit 304 monitors a status of each of the toner cartridges, and detects whether an exhausted toner cartridge is detected. The printing unit 220 includes a sensor that detects whether the toner is present or absent for each of a plurality of toner cartridges, and transmits a signal indicating the detection result to the toner cartridge control unit 304. Thus, the toner cartridge control unit 304 determines in which toner cartridge the toner is exhausted by checking the signal transmitted from the printing unit 220. According to the present exemplary embodiment, it is determined by detecting the toner exhaustion that a toner cartridge is lacking in toner.

When no exhausted toner cartridge is detected (NO in step S502), then instep S503, the toner cartridge control unit 304 determines whether printing ends. The print control unit 303 also notifies the toner cartridge control unit 304 whether printing ends. The toner cartridge control unit 304 monitors the presence or absence of an exhausted toner cartridge during a period from the start of printing to the end thereof.

When an exhausted toner cartridge is detected (YES in step S502), then in step S504, the toner cartridge control unit 304 performs printing suspension processing. In the printing suspension processing, the toner cartridge control unit 304 requests the print control unit 303 to suspend printing. The print control unit 303 suspends the printing operation of the printing unit 220. Thereafter, in step S505, the toner cartridge control unit 304 determines whether the printing operation of the printing unit 220 has been suspended.

Figure 6:
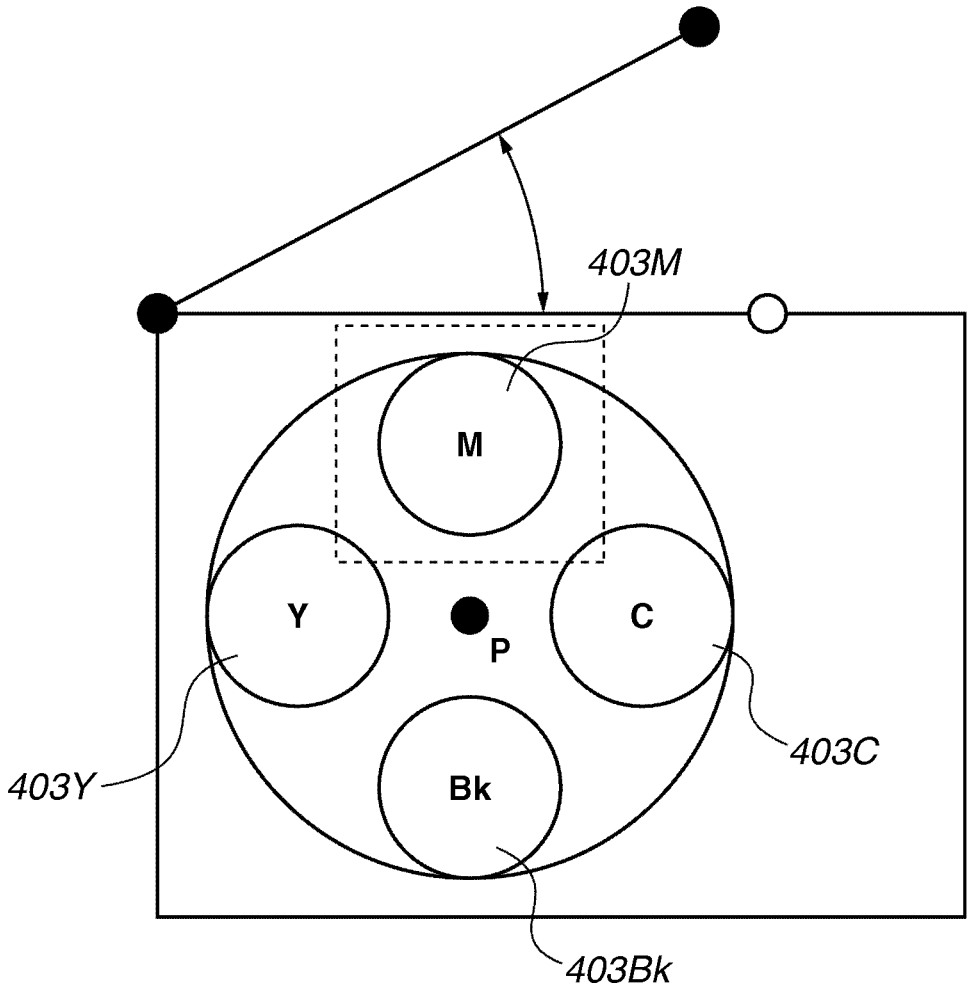
FIG. 6 illustrates a state in which a toner cartridge for magenta is moved to a replaceable position when toner of the toner cartridge for magenta is exhausted.

When the toner cartridge control unit 304 determines that the printing operation has been suspended (YES in step S505), then in step S506, the toner cartridge control unit 304 moves the exhausted toner cartridge to the replaceable position. FIG. 6 illustrates a state in which the toner cartridge for magenta is moved to the replaceable position when toner of the toner cartridge for magenta is exhausted. Referring to FIG. 6, the user can open the door 400 to replace the toner cartridge for magenta.

In step S507, the toner cartridge control unit 304 determines whether the exhausted toner cartridge has been replaced. A detection method of the replacement of the toner cartridge includes, e.g., a method for detecting the remaining amount of toner in the toner cartridge by the sensor after the door 400 is opened and closed. When the remaining amount of toner is detected and a sufficient amount of toner is then recognized, the toner cartridge control unit 304 determines that the toner cartridge has been replaced. There is another method for detecting the removal of the toner cartridge and attaching another toner cartridge by the sensor.

When the exhausted toner cartridge has been replaced (YES in step S507), then in step S508, the toner cartridge control unit 304 performs printing resumption processing. In the printing resumption processing, the toner cartridge control unit 304 requests the print control unit 303 to resume printing. The print control unit 303 causes the printing unit 220 to resume printing.

When the exhausted toner cartridge has not been replaced yet (NO in step S507), then in step S509, the toner cartridge control unit 304 determines whether the print job in progress of printing has been canceled. The print control unit 303 notifies the toner cartridge control unit 304 whether the print job has been canceled.

There are two cases (ways) of canceling the print job. In the first case, the user orders the cancel of the print job via the operation panel 230. In this case, the print control unit 303 cancels the print job in response to the order. In the second case, the printing apparatus 200 receives a control command for ordering the cancel of the print job from the host computer 100. In this case, the analysis unit 301 receives the control command from the communication control unit 207, and instructs the print control unit 303 to cancel the print job. The print control unit 303 cancels the print job in response to the instruction.

When the print job has been canceled without replacing the toner cartridge (YES in step S509), the toner cartridge control unit 304 checks for which color the exhausted toner cartridge is. In step S510, the toner cartridge control unit 304 determines whether the exhausted toner cartridge is for black.

When the exhausted toner cartridge is not for black (NO in step S510), then in step S511, the toner cartridge control unit 304 moves the toner cartridge for black to a specific position capable of starting monochrome printing most quickly. As a consequence, monochrome printing can start quickly.

In the color laser printer illustrated in FIG. 1, a position at which the toner cartridge for black is in contact with the photosensitive drum 715 is the position capable of starting monochrome printing most quickly (in FIG. 1, the toner cartridge for yellow is in contact with the photosensitive drum 715). However, the position capable of starting monochrome printing most quickly is not limited to this, and may be varied depending on a control manner of the printer controller 210 or a configuration of the printing unit 220.

On the other hand, when the exhausted toner cartridge is for black (YES in step S510), the toner cartridge for black is made to remain at the replaceable position.

According to the above-described exemplary embodiment, processing is performed for detecting an exhausted toner cartridge during printing. Hereinbelow, processing for detecting an exhausted toner cartridge during a printing standby state (idle state) is described.

Figure 7:
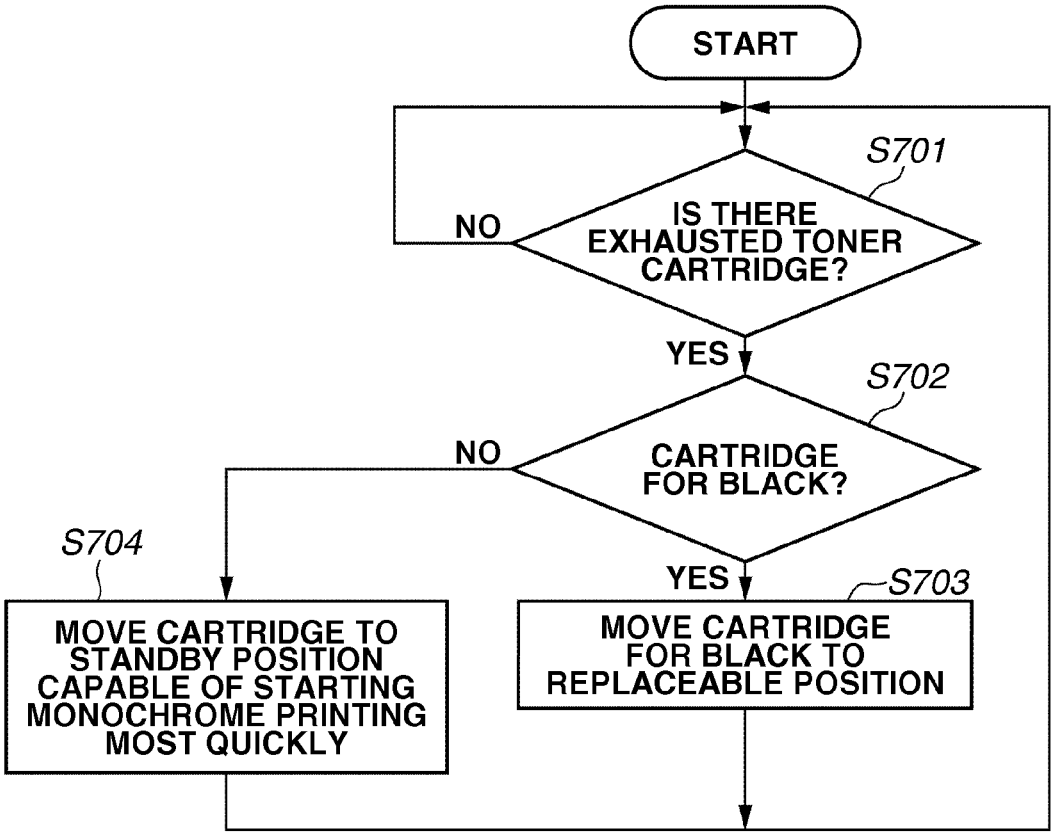
FIG. 7 illustrates a flowchart of second processing executed by the toner cartridge control unit according to an exemplary embodiment of the present invention.

FIG. 7 is a flowchart of second processing executed by the toner cartridge control unit 304 according to an exemplary embodiment of the present invention.

In step S701, the toner cartridge control unit 304 determines whether there is an exhausted toner cartridge.

When there is an exhausted toner cartridge (YES in step S701), then in step S702, the toner cartridge control unit 304 checks for which color the exhausted toner cartridge is, and determines whether the exhausted toner cartridge is for black.

When the exhausted toner cartridge is for black (YES in step S702), then in step S703, the toner cartridge control unit 304 moves the toner cartridge for black to the replaceable position.

On the other hand, when the exhausted toner cartridge is not for black (NO in step S702), then in step S704, the toner cartridge control unit 304 moves the toner cartridge for black to the standby position capable of starting monochrome printing most quickly. Even if the exhausted toner cartridge is not for black, when the user instructs the replacement of the toner cartridge via the operation panel 230, the toner cartridge control unit 304 moves the toner cartridge to the replaceable position.

With the processing thus executed, even when an exhausted toner cartridge is detected during the printing standby state, if the exhausted toner cartridge is for color other than black, monochrome printing can start quickly.

According to the above-described exemplary embodiment, when toner of the toner cartridge for color other than black is exhausted, the toner cartridge is set to the standby position capable of starting monochrome printing most quickly. When the printing apparatus 200 receives a print job for color printing in this state, the toner cartridge control unit 304 moves the exhausted toner cartridge to the replaceable position. Automatically moving the exhausted toner cartridge to the replaceable position enables the user to replace the toner cartridge promptly. Thus, usability can be improved.

The processing illustrated in FIGS. 5 and 7 moves a specific toner cartridge, such as a toner cartridge for black, to a specific position in preparation for printing using only the specific toner cartridge, thus preventing the delay for starting that printing. However, the specific toner cartridge is not limited to the toner cartridge for black, and the toner cartridge for another color may be used depending on the type of the printing apparatus. Further, the specific position may be different from that in FIG. 1 depending on the type of the printing apparatus.

According to an exemplary embodiment of the present invention, in a printing apparatus including a plurality of storing units storing a recording material, if a specific storing unit is not lacking in the recording material, it is possible to prevent the delay for starting printing using the specific storing unit.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-109546 filed May 11, 2010, which is hereby incorporated by reference herein in its entirety.

What is claimed is:

1. A printing apparatus for performing printing using a recording material, the printing apparatus comprising:

a plurality of moveable storing units arranged to store the recording material;

a determination unit arranged to determine whether at least one of the storing units is depleted of recording material; and a control unit arranged to, in the case that the determination unit determines that a storing unit is depleted while a print job is being executed , perform control to move the depleted storing unit to a replaceable position in which the depleted storing unit can be replaced , and arranged to, in the case that the depleted storing unit is not a specific storing unit among the plurality of storing units and the print job is cancelled without replacing the depleted storing unit, perform control to move the specific storing unit to a specific position in preparation for printing using the specific storing unit.

2. The printing apparatus according to claim 1, wherein the determination unit is arranged to determine whether the print job has been canceled and whether the depleted storing unit has been replaced.

3. The printing apparatus according to claim 1, wherein the control unit is arranged to perform control to resume printing of the print job in the case that the depleted storing unit has been replaced without canceling the print job.

4. The printing apparatus according to claim 1, wherein the specific storing unit is a storing unit storing a black recording material.

5. The printing apparatus according to claim 1, wherein the control unit is arranged to perform control to maintain the depleted storing unit at the replaceable position, without moving the depleted storing unit to the specific position, in the case that the depleted storing unit is the specific storing unit.

6. The printing apparatus according to claim 1, wherein the control unit is arranged to, in case that the depleted storing unit is the specific storing unit, perform control to move the depleted specific storing unit to the replaceable position.

7. The printing apparatus according to claim 6, wherein the control unit does not move the depleted specific storing unit to the specific position even if the print job is cancelled without replacing the depleted specific storing unit.

8. The printing apparatus according to claim 1, wherein the determination unit is further arranged to determine whether the depleted storing unit is the specific storing unit.

9. The printing apparatus according to claim 8, wherein the determination unit determines whether the depleted storing unit is the specific storing unit, after the print job is cancelled.

10. The printing apparatus according to claim 1, further comprising:

a sensor arranged to detect whether the recording material is present or absent for each of the plurality of storing units and transmit a signal indicating the detection result, wherein the determination unit checks the signal and determines which storing unit is depleted.

11. The printing apparatus according to claim 1, wherein the determination unit determines that a storing unit is depleted of recording material if the storing unit is lacking in recording material.

12. A control method for a printing apparatus for performing printing using a recording material, the printing apparatus including a plurality of moveable storing units arranged to store the recording material, the control method comprising:

determining whether at least one of the storing units is depleted of recording material;

performing, in the case that it is determined that a storing unit is depleted while a print job is being executed, control to move the depleted storing unit to a replaceable position in which the depleted storing unit can be replaced; and performing, in the case that the depleted storing unit is not a specific storing unit among the plurality of storing units and the print job is cancelled without replacing the depleted storing unit, control to move the specific storing unit to a specific position in preparation for printing using the specific storing unit.

13. The control method in accordance with claim 12, further comprising:

determining whether the print job has been cancelled; and determining whether the depleted storing unit has been replaced.

14. The control method in accordance with claim 12, further comprising:

performing control to resume printing of the print job in the case that the depleted storing unit has been replaced without cancelling the print job.

15. The control method in accordance with claim 12, wherein the specific storing unit is a storing unit storing a black recording material.

16. The control method in accordance with claim 12, wherein the depleted storing unit is maintained at the replaceable position without moving the depleted storing unit to the specific position, in the case that the depleted storing unit is the specific storing unit.

17. The control method in accordance with claim 12, wherein it is determined that a storing unit is depleted of recording material if the storing unit is lacking in recording material.

18. A printing apparatus for performing printing using a recording material, the printing apparatus comprising:

a plurality of moveable storing units arranged to store the recording material;

a determination unit arranged to determine whether at least one of the storing units is depleted of recording material; and a control unit arranged to, in the case that the determination unit determines that a storing unit is depleted, perform control to move the depleted storing unit to a replaceable position in which the depleted storing unit can be replaced, and arranged to, in the case that the depleted storing unit is not a specific storing unit among the plurality of storing units, perform control to move the specific storing unit to a specific position in preparation for printing using the specific storing unit, without replacing the depleted storing unit which has been moved to the replaceable position.

* * * * *